US012369689B2

(12) United States Patent
Wang

(10) Patent No.: US 12,369,689 B2
(45) Date of Patent: Jul. 29, 2025

(54) SMART INSOLE SPECIAL FOR GOLF

(71) Applicant: Zining Wang, Shenzhen (CN)

(72) Inventor: Zining Wang, Shenzhen (CN)

( * ) Notice: Subject to any disclaimer, the term of this patent is extended or adjusted under 35 U.S.C. 154(b) by 134 days.

(21) Appl. No.: 18/307,312

(22) Filed: Apr. 26, 2023

(65) Prior Publication Data

US 2024/0358118 A1 Oct. 31, 2024

(51) Int. Cl.

| | |
|---|---|
| ***A43B 17/00*** | (2006.01) |
| ***A43B 1/00*** | (2006.01) |
| ***A43B 3/44*** | (2022.01) |
| ***A43B 5/00*** | (2022.01) |
| ***A43B 17/08*** | (2006.01) |
| ***A43B 17/14*** | (2006.01) |

(52) U.S. Cl.
CPC ..... *A43B 17/003* (2013.01); *A43B 1/0045* (2013.01); *A43B 3/44* (2022.01); *A43B 5/001* (2013.01); *A43B 17/08* (2013.01); *A43B 17/14* (2013.01)

(58) Field of Classification Search
CPC ..... A43B 17/08; A43B 17/14; A43B 1/0045; A43B 3/44; A43B 7/08; A43B 7/081; A43B 7/082
See application file for complete search history.

(56) References Cited

U.S. PATENT DOCUMENTS 3,475,836 A * 11/1969 Brahm ..... A43B 17/08 36/3 R
3,716,930 A * 2/1973 Brahm ..... A43B 1/0045 36/3 B
4,224,746 A * 9/1980 Kim ..... A43B 17/08 36/44
4,257,176 A * 3/1981 Hartung ..... A43B 17/102 428/305.5
4,557,060 A * 12/1985 Kawashima ..... A43B 3/0047 36/44
4,602,441 A * 7/1986 El Sakkaf ..... A43B 7/082 36/3 R
4,658,515 A * 4/1987 Oatman ..... A43B 17/14 36/31
4,860,463 A * 8/1989 Pin ..... A43B 7/081 36/3 R (Continued)

FOREIGN PATENT DOCUMENTS

CN 108669704 A * 10/2018
WO WO-9513715 A1 * 5/1995 ..... A43B 13/203
WO WO-2018032365 A1 * 2/2018 ..... A43B 3/00

*Primary Examiner* — Heather Mangine, Ph.D.
(74) *Attorney, Agent, or Firm* — Hemisphere Law, PLLC; Zhigang Ma

(57) ABSTRACT

The present disclosure provides a smart insole special for golf, belonging to the technical field of insoles. The smart insole includes a toe portion and a heel portion; inside the toe portion and the heel portion is formed a communicated cavity, the toe portion is formed with a groove, inside which groove is formed a plurality of through holes, the through holes are communicated with the cavity, one end inside the cavity close to the heel portion has a top fixedly connected to a partition block, and the cavity has an area located at a bottom of the heel portion filled with a porous sponge. The present disclosure can be combined with different application scenarios, select different usage modes, and improve the comfort specifically.

3 Claims, 4 Drawing Sheets

(56) References Cited

U.S. PATENT DOCUMENTS 4,930,232 A * 6/1990 Engle ..... A43B 17/14 36/71
5,010,661 A * 4/1991 Chu ..... A43B 17/08 36/43
5,068,981 A * 12/1991 Jung ..... A43B 17/08 36/35 B
5,138,775 A * 8/1992 Chu ..... A43B 7/06 36/3 R
5,224,277 A * 7/1993 Sang Do ..... A43B 7/082 36/3 R
5,261,169 A * 11/1993 Williford ..... A43B 17/102 36/43
5,341,581 A * 8/1994 Huang ..... A43B 17/08 36/29
5,367,788 A * 11/1994 Chen ..... A43B 7/06 36/2.6
5,373,651 A * 12/1994 Wood ..... A43B 3/44 36/114
5,400,526 A * 3/1995 Sessa ..... A43B 7/081 36/3 R
5,465,508 A * 11/1995 Bourdeau ..... A43B 17/102 36/44
5,799,413 A * 9/1998 Argyris ..... A43B 7/146 36/3 R
5,813,142 A * 9/1998 Demon ..... A43B 13/206 600/592
5,815,949 A * 10/1998 Sessa ..... A43B 1/0072 36/28
5,829,167 A * 11/1998 Valenzuela ..... A43B 17/102 36/71
5,921,003 A * 7/1999 Kim ..... A43B 1/0045 36/136
5,950,332 A * 9/1999 Lain ..... A43B 17/035 36/35 B
5,974,694 A * 11/1999 Vecchiola ..... A43B 17/08 36/3 B
5,975,861 A * 11/1999 Shin ..... F04B 33/00 36/35 B
6,775,926 B1 * 8/2004 Huang ..... A43B 13/206 36/3 B
2001/0011426 A1 * 8/2001 Tomat ..... A43B 7/081 36/3 R
2002/0100187 A1 * 8/2002 Polegato ..... A43B 7/125 36/3 R
2004/0221481 A1 * 11/2004 Regen ..... A43B 1/0045 36/29
2005/0034335 A1 * 2/2005 Shows ..... A43B 7/081 36/141
2005/0196458 A1 * 9/2005 Valenzuela ..... A43B 1/0045 222/310
2006/0083912 A1 * 4/2006 Park ..... B29C 44/06 264/413
2006/0143943 A1 * 7/2006 Cho ..... A43B 13/203 36/3 B
2006/0265900 A1 * 11/2006 Lin ..... A43B 7/081 36/3 B
2007/0011908 A1 * 1/2007 Huang ..... A43B 1/0045 36/3 B
2007/0028483 A1 * 2/2007 Miyata ..... A43B 7/088 36/3 B
2007/0094890 A1 * 5/2007 Cho ..... A43B 13/203 36/3 B
2007/0209229 A1 * 9/2007 Maxner ..... A43B 23/24 36/83
2007/0277397 A1 * 12/2007 Chen ..... A43B 7/142 36/145
2007/0294923 A1 * 12/2007 Hayakawa ..... A43B 17/08 36/3 B
2008/0295360 A1 * 12/2008 Gazzola ..... A43B 7/06 36/102
2009/0083995 A1 * 4/2009 Hsieh ..... A43B 7/082 36/43
2010/0132228 A1 * 6/2010 Polegato Moretti ... A43B 7/125 36/3 B
2010/0275467 A1 * 11/2010 Tsai ..... A43B 17/02 36/44
2010/0275468 A1 * 11/2010 Shelton ..... A43B 7/144 36/43
2011/0056092 A1 * 3/2011 Tsiantos ..... A43B 1/0054 36/103
2011/0153261 A1 * 6/2011 Jang ..... A43B 3/34 342/450
2012/0174436 A1 * 7/2012 Hanak ..... A43B 7/144 36/43
2013/0067766 A1 * 3/2013 Chou ..... A43B 17/08 36/43
2013/0239443 A1 * 9/2013 Lin ..... A43B 7/08 36/3 B
2014/0259756 A1 * 9/2014 Pan ..... A43B 7/087 36/43
2015/0059204 A1 * 3/2015 Alexander ..... A43B 3/0084 36/44
2015/0282556 A1 * 10/2015 Zsolcsak ..... A43B 3/38 219/211
2015/0351664 A1 * 12/2015 Ross ..... A43B 17/00 702/44
2015/0359212 A1 * 12/2015 Bulger ..... A43B 7/081 36/136
2016/0029740 A1 * 2/2016 Möhlmann ..... A43B 13/203 36/3 B
2016/0263375 A1 * 9/2016 Wu ..... A61N 1/37217
2017/0295885 A1 * 10/2017 Stern ..... F16F 15/04
2018/0084865 A1 * 3/2018 Tang ..... A43B 17/08
2018/0310661 A1 * 11/2018 Cothren ..... A43B 7/005
2018/0317598 A1 * 11/2018 Möhlmann ..... A43B 7/085
2019/0069631 A1 * 3/2019 Mitchell ..... B32B 27/40
2019/0082771 A1 * 3/2019 Shin ..... A61B 5/6807
2019/0116921 A1 * 4/2019 Park ..... A43B 7/088
2020/0128914 A1 * 4/2020 Bosmans ..... A43B 17/08
2020/0170336 A1 * 6/2020 Lucca ..... A43B 13/12
2020/0281324 A1 * 9/2020 Möhlmann ..... B29D 35/0009
2021/0022666 A1 * 1/2021 Malawey ..... A43B 17/006
2021/0219655 A1 * 7/2021 Duemler ..... A43B 7/146
2021/0298413 A1 * 9/2021 You ..... G01L 5/0004
2021/0366249 A1 * 11/2021 Cho ..... H04B 17/318
2022/0095739 A1 * 3/2022 Brackenbury ..... A43B 17/14
2022/0386736 A1 * 12/2022 Cho ..... A61H 23/02
2023/0155523 A1 * 5/2023 Andosca ..... H10N 30/098 36/136
2023/0290258 A1 * 9/2023 Isgar ..... A43B 3/44
2024/0090620 A1 * 3/2024 Khan ..... A61B 5/1038
2024/0157123 A1 * 5/2024 Atashbar ..... A43B 7/147
2024/0164714 A1 * 5/2024 Alsafran ..... A61B 5/7267
2024/0358118 A1 * 10/2024 Wang ..... A43B 1/0045

* cited by examiner

SMART INSOLE SPECIAL FOR GOLF

TECHNICAL FIELD

The present disclosure relates to the technical field of insoles, more particular to a smart insole special for golf.

BACKGROUND

Golf is a game practiced outdoors, for which the course is required to have pleasant winds between hills and have ponds and streams that create so-called "water hazards". Such features make golf a sport both physically beneficial and mentally beneficial.

Existing insoles have some deficiencies in moisture transfer, which could easily cause wet toes and insufficient comfort to wear.

SUMMARY

The present disclosure aims to solve the shortcomings in the existing technologies and provide a smart insole special for golf that can solve the problems in the existing technologies.

In order to achieve the above aim, the present disclosure employs the following technical solution.

A smart insole special for golf includes a toe portion and a heel portion, wherein inside the toe portion and the heel portion is formed a communicated cavity, the toe portion is formed with a groove, inside which groove is formed a plurality of through holes, the through holes are communicated with the cavity, one end inside the cavity close to the heel portion has a top fixedly connected to a partition block, and the cavity has an area located at a bottom of the heel portion filled with a porous sponge.

The cavity is internally fixedly connected to a plurality of pressure sensors at intervals, the heel portion has a bottom of an inside thereof fixedly provided with a control box, and the control box is provided internally with a storage battery, Bluetooth and a controller.

Preferably, inside the partition block is formed an accommodation cavity, the partition block has a side face formed with a filling hole, the filling hole has an inner side fixedly connected to an elastic film, the elastic film has an upper end and a lower end fixedly connected to an inner wall of the cavity, and the accommodation cavity is filled with refreshing powder.

The accommodation cavity is formed with a discharge hole at a bottom of one end thereof close to the heel portion, the partition block and the cavity have support bars provided at intervals therebetween, and the discharge hole is positioned above a channel between the two support bars.

Preferably, the refreshing powder is composed of boric acid, zinc oxide, salicylic acid, borneol, menthol, camphor and talc powder.

Preferably, the accommodation cavity has one end close to the heel portion provided with a curved bar.

Preferably, the heel portion has a massage bump provided on an upper side of a front end thereof.

Preferably, the heel portion has a rear end formed with an air inlet, the air inlet has an inner side provided with a shielding film, and the shielding film has an upper end and a lower end fixedly connected to an inner wall of the air inlet respectively.

The present disclosure has the following advantages. The smart insole special for golf provided by the present disclosure is applicable to the case that the toes perspire slightly.

The wearer just needs to trample on the heel portion using his heel, whereby repeatedly extruding the porous sponge. The porous sponge is restored to cooperate with the one-way refill of air of the air inlet, making the air blown into the through holes of the groove of the toe portion, so that the toes get aired more rapidly and the comfort is improved.

In the case that the toes perspire heavily, if the sweat is not wicking in a timely manner, it could easily soak the toes, causing the limbs to become white and bloated. When it is inconvenient to take off the shoes, the wearer may raise the toe portion and let the heel portion repeatedly touch the ground. Since the sole does not apply a force to the position of the partition block, a gap is formed between the curved bar and the top wall of the accommodation cavity, so that the refreshing powder filled in the accommodation cavity may fall into the channel formed between the two support bars. By the time, as the heel repeatedly touches the ground, the cavity of the porous sponge is repeatedly compressed to blow air to the channel formed between the two support bars, so that the refreshing powder is blown to the toe portion to keep the toes dry and comfortable.

DETAILED DESCRIPTION OF THE EMBODIMENTS

To make the purpose, the technical scheme and the advantages of the present disclosure more clearly understood, the present disclosure is described below in further detail in conjunction with accompanying drawings and embodiments. It should be understood that the specific embodiments described below are merely to illustrate, but to limit, the present disclosure.

Figure 1:
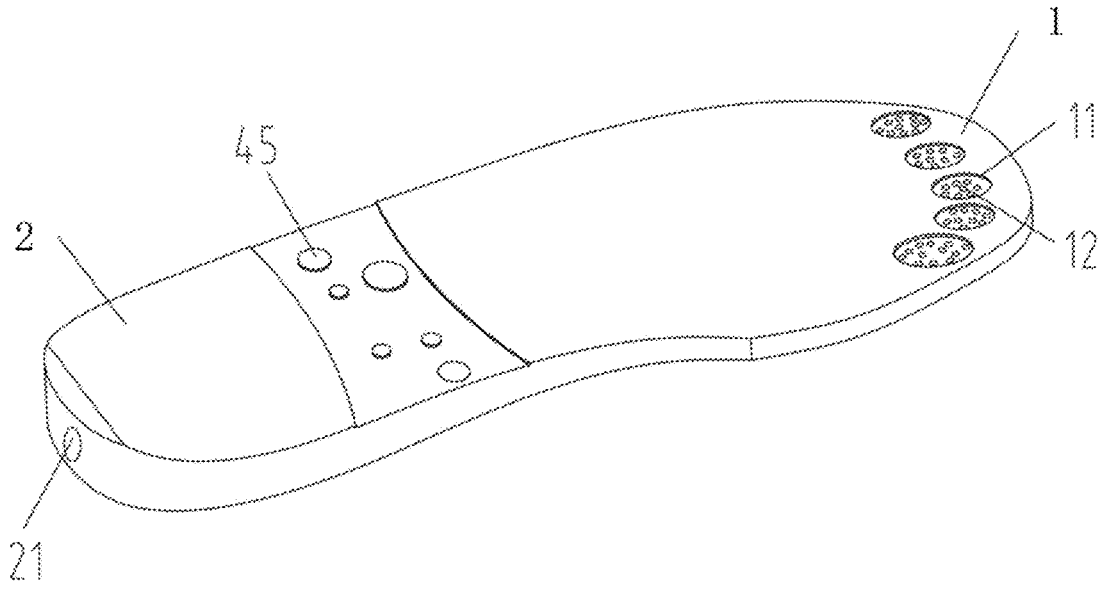
FIG. 1 is a basic structure diagram of the present disclosure.
Figure 2:
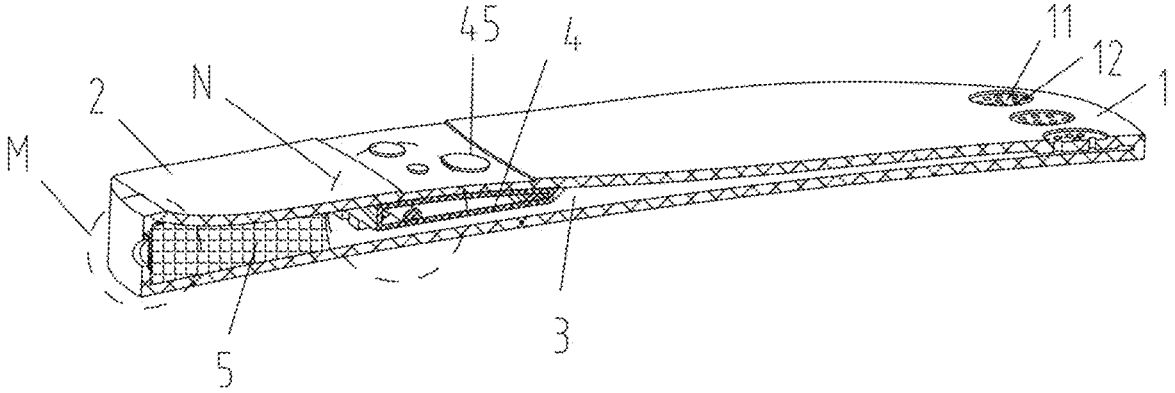
FIG. 2 is an internal structure diagram of the present disclosure.
Figure 3:
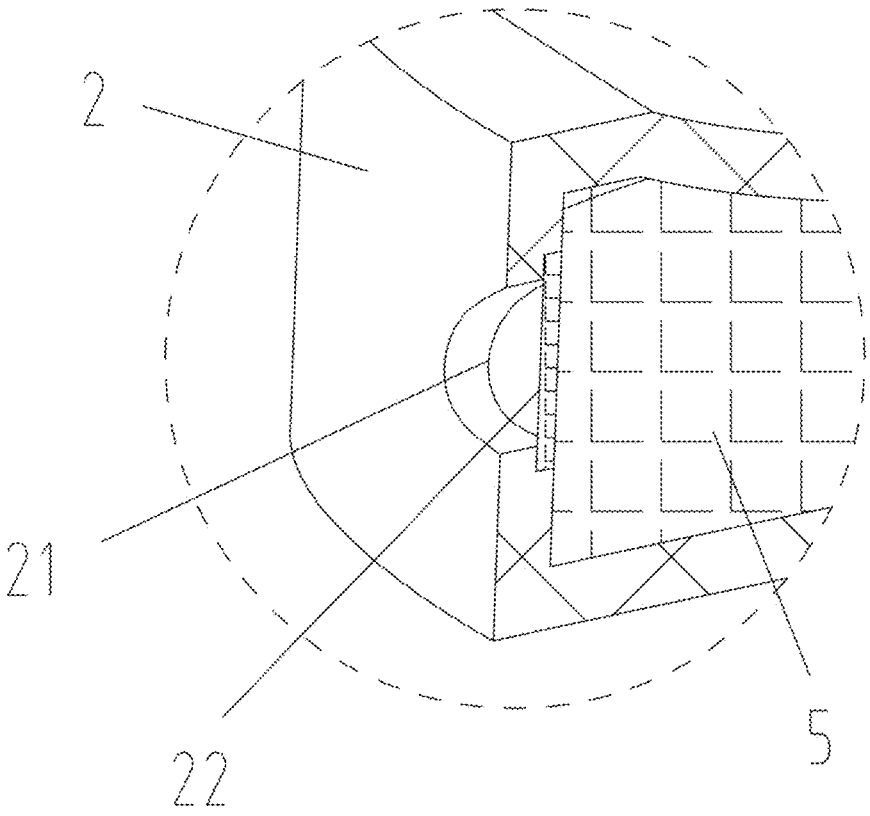
FIG. 3 is a partial enlargement view of part M shown in FIG. 2.
Figure 4:
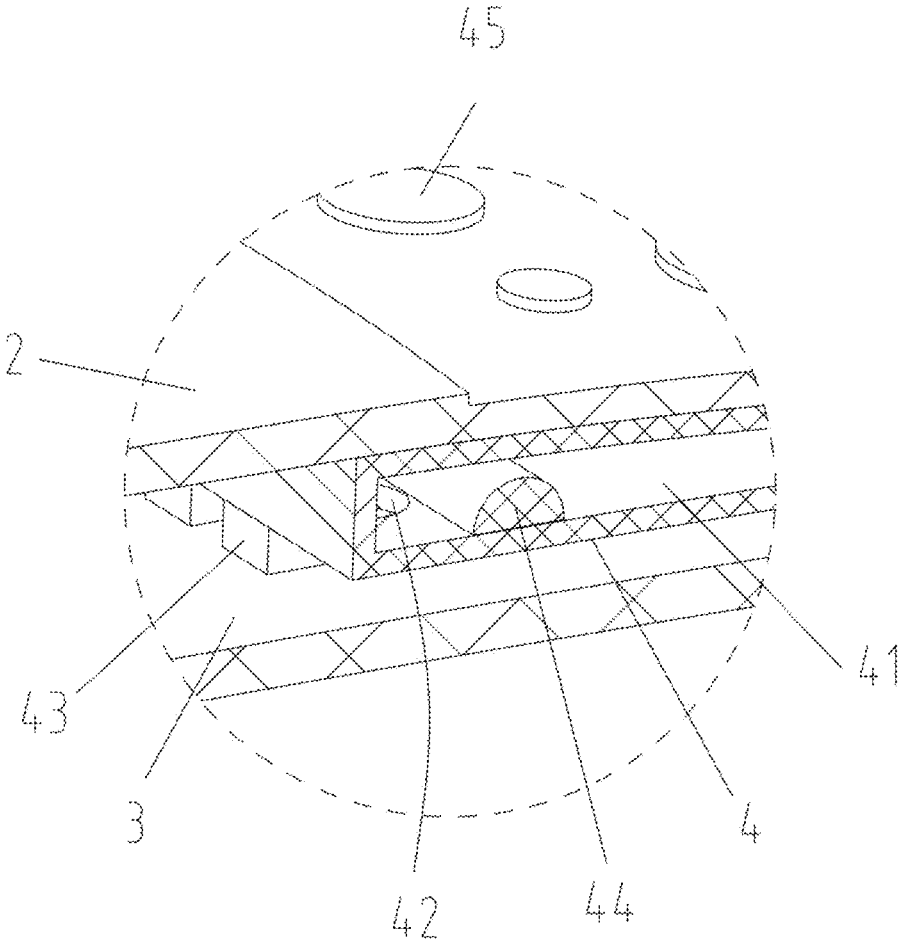
FIG. 4 is a partial enlargement view of part N shown in FIG. 2.

As shown in FIG. 1 to FIG. 4, a smart insole special for golf provided by the present disclosure includes a toe portion 1 and a heel portion 2. Inside the toe portion 1 and the heel portion 2 is formed a communicated cavity 3, inside which cavity 3 is provided a plurality of support pads, preventing the cavity 3 being closed due to a downward pressure from a full contact with a sole. The toe portion 1 is formed with a groove 11, inside which groove 11 is formed a plurality of through holes 12. The through holes 12 are communicated with the cavity 3. One end inside the cavity 3 close to the heel portion 2 has a top fixedly connected to a partition block 4, and the cavity 3 has an area located at a bottom of the heel portion 2 filled with a porous sponge 5. Inside the porous sponge 5 is formed a plurality of channels for air to flow.

The cavity 3 is internally fixedly connected to a plurality of pressure sensors at intervals, the heel portion 2 has a bottom of an inside thereof fixedly provided with a control box, and the control box is provided internally with a storage battery, Bluetooth and a controller. The storage battery is provided with a USB interface, to ease charging. When a wearer of the smart insole is exercising, the pressure sensor acquires the weight and pressure information of the user, the heading direction, gesture, acceleration value and sampling rate of the foot, and collects the exercise habits of the wearer. Then the collected information is transmitted to a mobile phone through the BLUETOOTH®, to generate models for different users, whereby to perform training adjustment or provide suggestions by means of the data.

Inside the partition block 4 is formed an accommodation cavity 41. The partition block 4 has a side face formed with a filling hole, and the filling hole has an inner side fixedly connected to an elastic film. The elastic film has an upper end and a lower end fixedly connected to an inner wall of the cavity 3. The accommodation cavity 41 is filled with refreshing powder. The refreshing powder is composed of boric acid, zinc oxide, salicylic acid, borneol, menthol, camphor and talc powder.

The filling hole is configured to refill the refreshing powder into the accommodation cavity 41. The elastic film is jacked open during the refilling course. The refilled refreshing powder enters the accommodation cavity 41 from a lateral side of the elastic film. When the refilling tube gets away, the elastic film is restored to seal the filling hole again. By the time, press the partition block 4, and the refreshing powder will not leak.

The accommodation cavity 41 is formed with a discharge hole 42 at a bottom of one end thereof close to the heel portion 2. The partition block 4 and the cavity 3 have support bars 43 provided at intervals therebetween. The discharge hole 42 is positioned above a channel between the two support bars 43. The accommodation cavity 41 has one end close to the heel portion 2 provided with a curved bar 44. The heel portion 2 has a massage bump 45 provided on an upper side of a front end thereof.

The heel portion 2 has a rear end formed with an air inlet 21, the air inlet 21 has an inner side provided with a shielding film 22, and the shielding film 22 has an upper end and a lower end fixedly connected to an inner wall of the air inlet 21 respectively. In combination of the compression and resilience of the porous sponge 5, air flow is formed and guided into the cavity 3. When the porous sponge 5 is compressed, the shielding film 22 blocks the air inlet 21. When the porous sponge 5 is restored, since the through hole 12 is a narrow hole, air first jacks open the shielding film 22 to enter the cavity 3, thereby achieving an effect of one-way transmission of air toward the through hole 12. The present disclosure presents a 3D profile, conforming to the contour of a human foot and conforming to the ergonomic structural design.

The present disclosure is used in combination with breathable mesh style golf shoes, which can achieve two different usage modes and acquire two different effects.

In the case that the toes perspire slightly, the wearer just needs to trample on the heel portion 2 using his heel, whereby repeatedly extruding the porous sponge 5. The porous sponge 5 is restored to cooperate with the one-way refill of air of the air inlet 21, making the air blown into the through holes 12 of the groove 11 of the toe portion 1, so that the toes get aired more rapidly and the comfort is improved.

In the case that the toes perspire heavily, if the sweat is not wicking in a timely manner, it could easily soak the toes, causing the limbs to become white and bloated. When it is inconvenient to take off the shoes, the wearer may raise the toe portion 1 by 30-45 degrees and let the heel portion 2 repeatedly touch the ground. Since the sole does not apply a force to the position of the partition block 4, a gap is formed between the curved bar 44 and the top wall of the accommodation cavity 41, so that the refreshing powder filled in the accommodation cavity 41 may fall into the channel formed between the two support bars 43. By the time, as the heel portion 2 repeatedly touches the ground, the cavity of the porous sponge 5 is repeatedly compressed to blow air to the channel formed between the two support bars 43, so that the refreshing powder is blown to the toe portion 1 to keep the toes dry and comfortable.

The present disclosure can be combined with different application scenarios, select different usage modes, and improve the comfort specifically.

Although the above has shown and described the embodiments of the present disclosure, it is understandable for the ordinary skill in the art that many modifications, changes, substitutions and transformations may be made to these embodiments without departing from the spirit and principle of the present disclosure. The scope covered by the present disclosure is defined by the claims appended hereinafter and equivalents thereof.

What is claimed is:

1. A smart insole special for golf, comprising a toe portion (1) and a heel portion (2), wherein inside the toe portion (1) and the heel portion (2) is formed a communicated cavity (3), the toe portion (1) is formed with a groove (11), inside said groove (11) is formed a plurality of through holes (12), the plurality of through holes (12) are communicated with the communicated cavity (3), one end inside the communicated cavity (3) close to the heel portion (2) has a top fixedly connected to a partition block (4), and the communicated cavity (3) has an area located at the heel portion (2) filled with a porous sponge (5);

wherein inside the partition block (4) is formed an accommodation cavity (41); the accommodation cavity (41) is formed with a discharge hole (42) at a bottom of one end of the accommodation cavity (41) close to the heel portion (2), a plurality of support bars (43) are provided at intervals between the partition block (4) and the communicated cavity (3), and the discharge hole (42) is positioned above a channel between two adjacent support bars among the plurality of support bars (43);

wherein the accommodation cavity (41) has the end close to the heel portion (2) provided with a curved bar (44).

2. The smart insole special for golf according to claim 1, wherein the heel portion (2) has a massage bump (45) provided on an upper side of a front end of the heel portion (2).

3. The smart insole special for golf according to claim 1, wherein the heel portion (2) has a rear end formed with an air inlet (21), the air inlet (21) has an inner side provided with a shielding film (22), and the shielding film (22) has an upper end and a lower end fixedly connected to the inner side of the air inlet (21) respectively.

* * * * *